United States Patent [19]

Knutsen

[11] Patent Number: 4,667,714

[45] Date of Patent: May 26, 1987

[54] APPARATUS AND METHOD FOR SAWING LIMBS AND THE LIKE

[76] Inventor: Morris N. Knutsen, 3550 NW. Mountain View Rd., Silverdale, Wash. 98383

[21] Appl. No.: 815,387

[22] Filed: Dec. 31, 1985

[51] Int. Cl.[4] ..... B27B 1/00

[52] U.S. Cl. ..... 144/379; 269/130; 269/131; 269/296

[58] Field of Search ..... 269/130, 131, 296; 144/366, 193 R, 379

[56] References Cited

U.S. PATENT DOCUMENTS

| | | | |
|---|---|---|---|
| 194,229 | 8/1877 | Emery | 269/131 |
| 691,633 | 1/1902 | Jincks et al. | 269/131 |
| 2,815,131 | 12/1957 | Lunsman et al. | 269/130 X |
| 4,454,929 | 6/1984 | Wellman | 269/296 |
| 4,457,504 | 7/1984 | Mottla | 269/296 |
| 4,566,559 | 1/1986 | van Asten | 269/296 |

*Primary Examiner*—W. D. Bray
*Attorney, Agent, or Firm*—Delbert J. Barnard

[57] ABSTRACT

A plurality of limbs or the like are secured together, to form a limb bundle (B). The limbs are positioned in a space defined laterally between a pair of posts (20, 24) on one side of a frame (12) and a second pair of posts (22, 26) on the opposite side of the frame (12). A windless (44) is supported at the upper ends of the posts (20, 24). A cable (54) extends from the windless (44) either downwardly and around the girth of the limb bundle (B), and then hooks on itself, to form a noose around the limb bundle (B), or it extends from the windless (44) down to and around a pulley (76), then upwardly and over a mid portion of the limb bundle (B'), and then down to a dead end connection (70) at a lower portion of the frame (12). In either case, tightening of the cable (54, 54') imposes a squeezing force on the limb bundle (B).

9 Claims, 8 Drawing Figures

Fig. 1
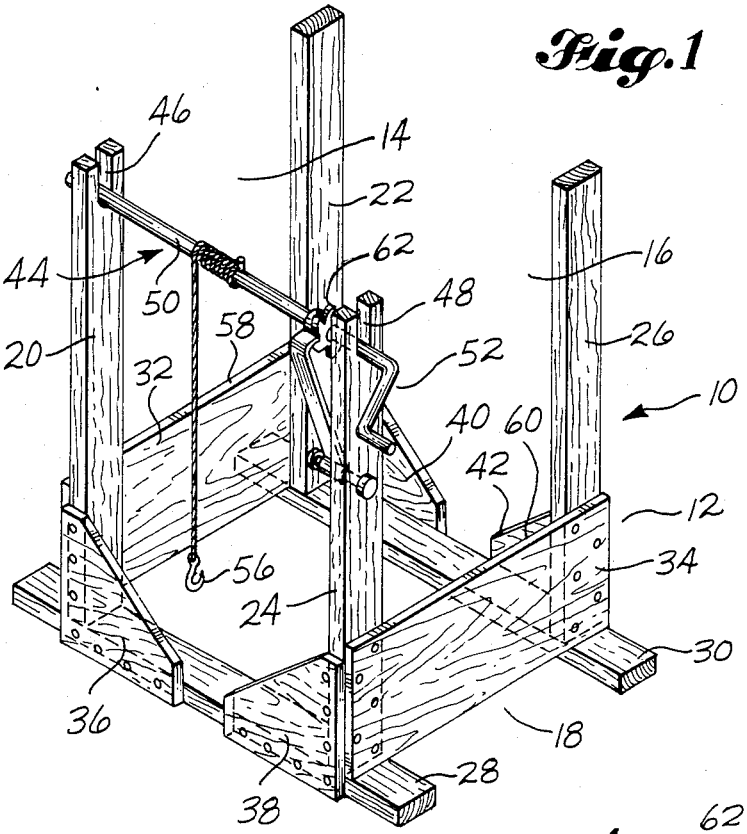
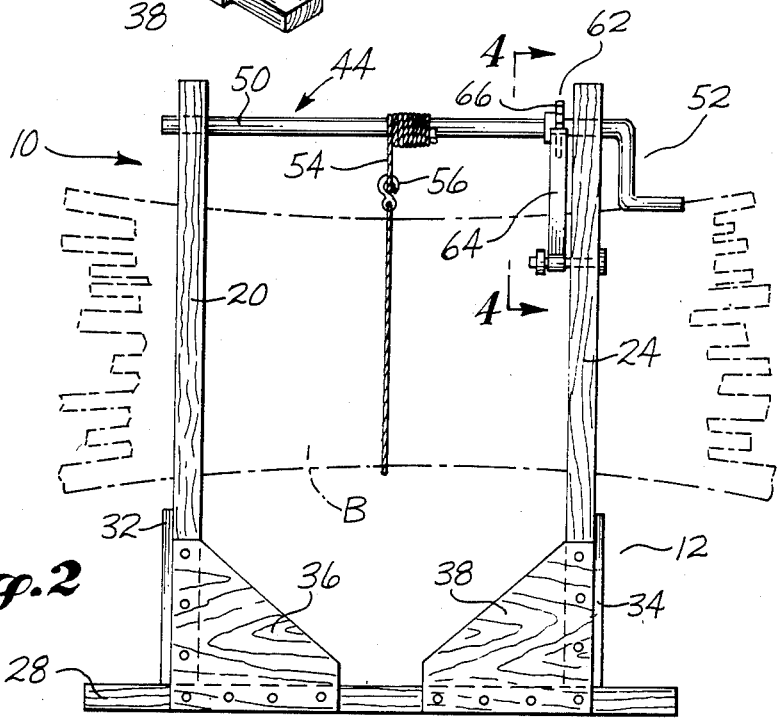
Fig. 2

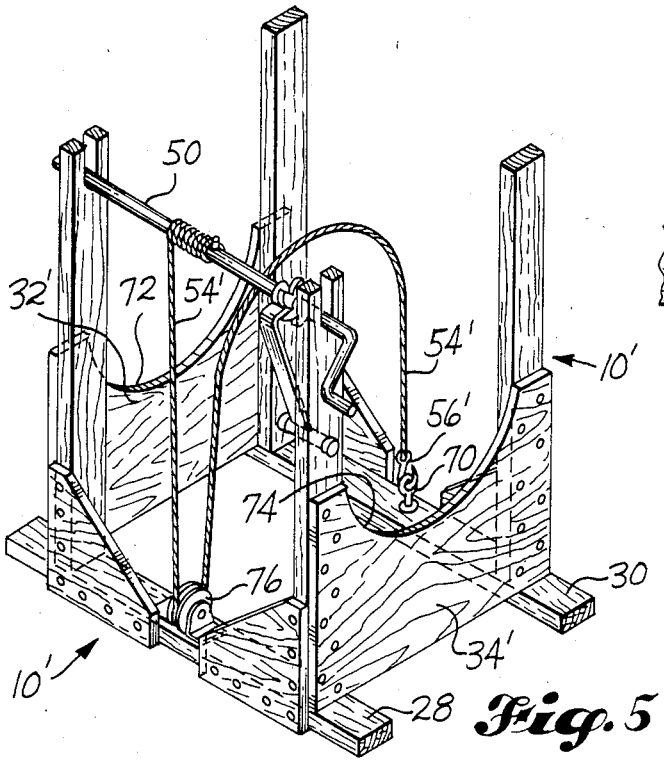
Fig. 5
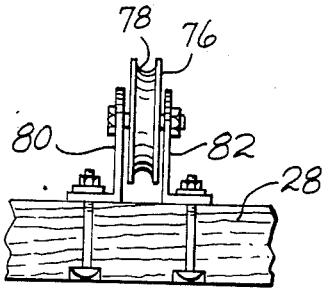
Fig. 8
Fig. 6
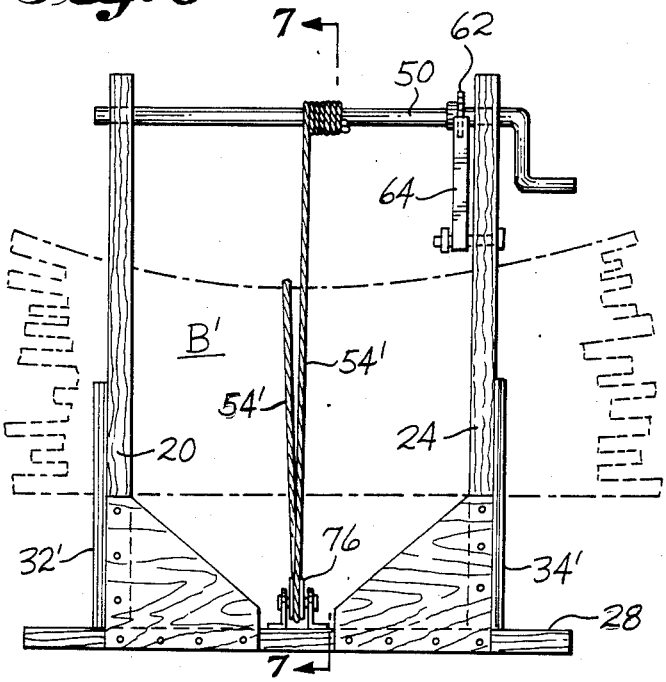

APPARATUS AND METHOD FOR SAWING LIMBS AND THE LIKE

TECHNICAL FIELD

The present invention relates to both an apparatus and method for cutting limbs or the like. More particularly, it relates to the provision of a sawbuck and a method for holding and maintaining a plurality of limbs or the like snugly together, in a bundle, while they are being cut by a saw.

BACKGROUND ART

Tree limbs are denser than the tree trunks and as a result they contain more btus of energy. However, it has been both difficult and time consuming to cut limbs. It takes a considerable amount of time to cut limbs if they are cut individually. Limbs are generally curved and/or crooked and do not normally lay tight together. Thus, if a group of limbs are merely stacked on top of each other, on a support, and then sawn, the cutting of the limbs results in movement of the limbs which makes it difficult to cut them and also makes the cutting dangerous.

It is an object of the present invention to provide an apparatus and method for cutting together a large number of limbs without the shifting in position of the limbs which make the cutting operation both difficult and dangerous.

DISCLOSURE OF THE INVENTION

In accordance with basic aspects of the invention, a sawbuck is provided for positioning the limbs at a convenient height for cutting, for holding the limbs together in a bundle, and for restraining both the bundle and the individual limbs from unwanted movement while cutting is taking place.

The term "sawbuck" is used herein in a broad sense, to denote an apparatus used for holding something as it is being cut by a saw.

It is contemplated that the saw that will be used for cutting the limbs or the like will be a chain saw.

Basically considered, a sawbuck constructed in accordance with the present invention comprises a frame and line means connected to the frame. The line means and frame cooperate to hold and maintain a plurality of limbs or the like snugly together, in a bundle, while they are being cut by a saw.

The holding of the bundle is such that as individual limbs or the like are being cut, and are being freed for movement by the cutting, a squeezing force on the bundle is immediately and automatically increased, to prevent movement of the individual members.

In accordance with one aspect of the invention, a line is thrown around the limb members and then hooked onto itself to form a noose or choker which forms the limbs into a bundle. The line is attached to the frame in such a way that the line picks up at least a portion of the weight of the bundle. This results in the bundle weight automatically tightening the noose in response to any shift in position of the limbs which would otherwise tend to loosen the bundle.

In accordance with another aspect of the invention, a line is used to clamp the limbs tightly between it and a cradling portion of the frame. About one half of the girth of the bundle is in contact with an abutment portion of the frame. The line then extends over the remaining one half of the girth of the bundle. The bundle is then tightly squeezed together, between the line and the frame, when tension is put into the line.

These and other more detailed features of the invention are described below in the description of the illustrated embodiments.

BRIEF DESCRIPTION OF THE DRAWING

In the drawings, like reference numerals are used to designate like parts throughout, and:

FIG. 1 is an isometric view of a first embodiment of the invention, taken from above and looking towards one side and one end of the sawbuck;

FIG. 2 is a side elevational view of the sawbuck shown by FIG. 1, such view including a phantom line showing of a bundle of limbs or the like;

FIG. 5 is a view like FIG. 1, but of a second embodiment of the invention;

FIG. 6 is a view like FIG. 2, but the embodiment shown by FIG. 5, such view including a broken line showing of a bundle of limbs or the like;

FIG. 8 is an enlarged scale view of pulley shown in FIGS. 5–7.

BEST MODE FOR CARRYING OUT THE INVENTION

Figure 3:
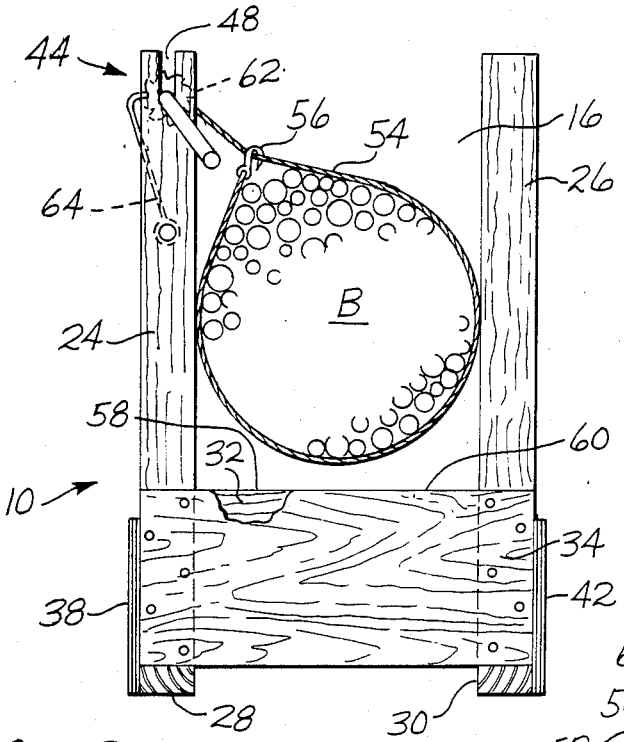
FIG. 3 is an end elevational view looking towards the right end of FIGS. 1 and 2, such view showing a bundle of limbs or the like contained within a noose and suspended from an upper portion of the sawbuck, so that the weight of the limbs functions to keep the noose tight.
Figure 4:
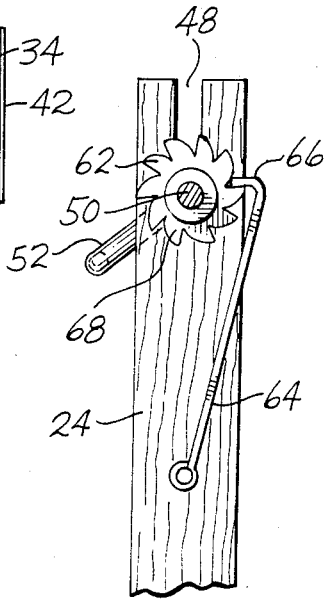
FIG. 4 is an enlarged scale fragmentary sectional view taken substantially along line 4—4 of FIG. 2, presenting a side elevational view of a ratchet type lock mechanism.
Figure 7:
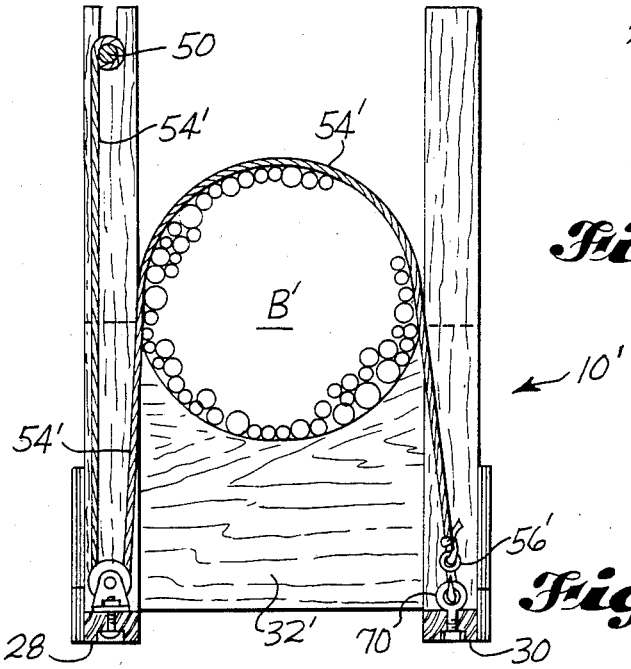
FIG. 7 is a sectional view taken substantially along line 7—7 of FIG. 6.

The sawbuck 10 shown by FIGS. 1–4 comprises a frame 12 which is basically characterized by a pair of spaced apart ends which define upwardly opening cradles for receiving a bundle B of limbs or the like. The bundle B is received within spaces 14, 16.

Frame 12 comprises a base 18 and four upwardly extending posts 20, 22, 24, 26.

Frame 12 may be constructed from wood members, as is illustrated. It may comprise a pair of base legs 28, 30 constructed from planks of two inch lumber (e.g. 2×4's or 2×6's). Corner post 20, 22, 24, 26 may also be constructed from two inch plank lumber and are preferably made from the same size lumber as the base members 28, 40. Rectangular walls 32, 34 may connect together the lower end portions of the post 20, 22 and 24, 26, respectively. These members 32, 34 may be pieces of plywood. Gussets 36, 38, 40, 42 may be provided at the sides of the frame 12, to complete the base. Gussets 36, 38, 40, 42 may also be constructed from plywood.

Preferably, the ends of the base members 28, 30 extend outwardly a short distance beyond the endwalls 32, 34, for adding stability to the frame 12.

In this embodiment, a windlass 44 is mounted on an upper side portion of the frame 12. The upper end portions of the post 20, 24 may be cut to include upwardly opening slots 46, 48. The windlass may be an elongated bar 50 having a handle 52 at one end. As shown by FIGS. 1 and 2, end portions of the bar 50 are merely set down into the slots 46, 48, with the handle 52 situated outwardly of the post 24. A wire rope 54 or the like is connected at one end to the bar 50. A hook 56 is provided at the opposite end of the line 54. As best shown by FIG. 3, in this embodiment the line 54 is wrapped around the bundle B and then the hook 56 is attached to the line 54. This creates a noose or choker which extends around the limbs and binds them together to form the bundle B. Preferably, the line 54 is wrapped onto the bar 50 a sufficient amount to transfer to the line 54 at least a part of the weight of the bundle B. In FIG. 3, the bundle B is shown to be elevated above the upper edges 58, 60 of the endwalls 32, 34.

The windlass 44 may include a ratchet wheel 62 connected to the shaft 50 immediately inwardly of the corner post 24. A lock bar 64 may be secured at its lower end to the post 24 and include at its upper end a pawl 66 which cooperates with the teeth 68 of ratchet wheel 62 to prevent unwanted reverse rotation of the shaft 50. As is known per se, rotation of the handle 52 in the winding direction results in the curved leading surfaces of the teeth 68 camming the pawl outwardly, so that the shaft 50 can rotate. Reverse rotation is prevented by an interference between the pawl 66 and the straight sides of the teeth 68. Wanted reverse rotation can be easily obtained by the user pulling on the member 64, to disengage the pawl 66 from the ratchet wheel 62.

In this embodiment, the limb bundle B is supported from an upper side portion of the frame 12. Thus, the weight of the bundle B will not only maintain tension in the line 54, for the purpose of keeping the noose tight around the bundle B, but it will hold the bundle B against a pair of posts 20, 24. It is in this manner that the frame and line means in this embodiment hold and maintain the plurality of limbs or the like snugly together in a bundle while they are being sawed.

As earlier explained, limbs are not perfectly straight. As a result, when they are bundled together, they make contact with each other only at spaced apart locations at their lengths. Then, as the members are cut, there is a shift in the location of the points of contact. As a result, it is very difficult to merely stack a group of limbs together and then cut them with a saw. The crooked limbs shift in position as they are cut. This shifting in position makes it not only difficult but dangerous to merely stack together a plurality of limbs and then try to cut through the stack.

The provision of the noose or choker around the bundle B, combined with the line 54 being tensioned so as to lift at least a portion of the weight of the bundle B, results in the noose automatically tightening itself in response to shifts in position of individually cut limbs.

The gussetts 36, 38, 40, 42 are used in place of solid walls extending from each side post over to the other side post on each side of the frame 10 so that an avenue will be defined laterally across the frame, in the region below the bundle B (see FIG. 2). This enables one to insert the cutting portion of a chain saw into such avenue and use it for cutting up on the limbs, on one side or other of the noose.

This arrangement makes it possible for a user to make two cuts for each grip on the bundle B. The first cut is made outside of an end of the frame 12. The second cut can then be made inside of the frame, closely adjacent the noose. The outside cut may be made in the downward direction in which case the saw may first swing the bundle B into a position of contact with a portion of the frame, so that the frame will back up the cutting forces. As explained above, the inside cut may involve an upward pass of the saw blade. During such cutting the bundle B will most likely make contact with an opposite end portion of the frame 10.

FIGS. 5–8 illustrate a second way of holding together a plurality of limbs or like members in a bundle, and maintaining a squeezing force on the bundle, as the individual limbs are being cut.

Referring to FIGS. 5–8, the frame 10' may be identical to frame 10, except for the construction of the end walls 32', 34'. In this embodiment, the orientation of the line 54' is also different. In this embodiment the end of the line 54' opposite the windlass shaft 50 is connected (i.e. dead ended) to a lower central portion of the base member 30. As illustrated, the base member 30 may be provided with an eyebolt 70 to which the hook 56' is attached. In this embodiment the group of limbs that will form the bundle B' are set down onto the upper edge surfaces 72, 74 of the endwalls 32', 34'. These edges 72, 74 function as abutments. The line 54' is wrapped onto the windlass shaft 50, as before. It then extends downwardly to a pulley 76 that is secured to the central portion of base member 28, generally laterally across the frame 10' from the eyebolt 70. As shown by FIG. 8, the pulley 76 includes a peripheral groove 78 in which the line 54' rides. The line 54' extends down around the lower half of the pulley wheel 76 and then extends upwardly. The user draws it up over the upper boundary of the group of limbs which are then supported on the abutments 72, 34. The hook 56' is then hooked onto the eyebolt 70. Then, the windlass 44 is operated to wind the line 54' on the shaft 50. The winding continues until a sufficient tension exists in the line 54' to cause it and the abutments 72, 74 to squeeze between them the limbs or other elongated members, so as to hold such members together in a bundle, and maintain a squeezing force on said members, so that they will be restrained as a group, and a saw can be used for cutting them.

In this embodiment it might be desirable to spring load the eyebolt 70 and or the pulley 76, so that tightening of the line 54' will store energy in the springs. The storage spring energy can then function to help maintain tension in the line 54, in response to shifting in position of the limbs as they are being cut.

FIG. 8 shows a stationary mounting of the pulley 76. The lower legs of a pair of angle brackets are simply bolted to the member 28. A support shaft for the pulley 70 extends through the vertical legs of the brackets 80, 82. The bolts used for securing the brackets 80, 82 in place may thread into nuts which are countersunk into lower portions of the frame member 28.

The embodiments which have been described above are presented for example purposes only. The invention is not to be limited by the details of these example embodiments, but only by an interpretation of the following claims. It is intended that the claims cover devices and methods which meet the literal terms of the claims, and equivalent devices and methods as well.

What is claimed is:

1. A method of sawing a plurality of limbs or like members which are relatively small in cross sectional shape, comprising:

bundling a plurality of such members together;

exerting a squeezing force on said members so as to hold and maintain them snugly together;

holding the bundle of members relatively fixed in position by drawing a line means around a girth portion of the bundle of members and then connecting said line means to itself with a running connection, to form a noose around the bundle of members, and then supporting and guiding the rest of the line means such that the noose and the bundle of members within the noose are suspended and at least a portion of the weight of the bundle members is carried by the line means, so that the noose automatically re-tightens itself in response to limb imposing forces on the bundle being relieved as limbs reposition themselves as they are being cut; and using a saw to cut across the bundle.

2. A method according to claim 1, comprising providing an upwardly opening cradle having a lower abutment, placing the bundle of members in said cradle and resting it on the abutment, connecting a tension line to a side of the cradle, then extending the tension line up and over a portion of the bundle of members, and then downwardly on the opposite side of the cradle, and tensioning said tension line so that it and the abutment cooperate to apply a squeezing force on the bundle of members, to hold and maintain them snugly together while they are being cut by a saw.

3. A sawbuck for limbs or the like, comprising:

a frame which in use is located in a stationary position;

line means connected to and cooperating with said frame, and forming a noose around the bundle of limbs, to hold and maintain a plurality of limbs snugly together in a bundle while they are being cut by a saw; and suspension means on said frame for said line means, positioned above the noose, so that the line means extends downwardly from the suspension means to the noose and the bundle of limbs being held thereby, wherein at least some of the weight of the limbs is carried by the line means, so that such weight maintains a tension in the line means which causes the noose to continuously tighten around the bundle of limbs as limb imposed forces on the bundle are relieved as the limbs are being cut.

4. A sawbuck according to claim 3, wherein the frame includes a support base and upstanding frame members defining a space above the base and laterally between the members in which the bundle of limbs are situated.

5. A sawbuck according to claim 3 wherein the line means exerted a squeezing force on the bundle of limbs which continuously recompacts the limbs during cutting as limb forces on the bundle are relieved by the cutting of the limbs.

6. A sawbuck according to claim 5, wherein said line means forms a noose around the bundle of limbs.

7. The sawbuck according to claim 3, wherein the suspension means for the line means is a windlass supported by said frame.

8. A sawbuck according to claim 7, wherein the frame includes a support base and upstanding frame members defining a space above the base and laterally between the members in which the bundle of limbs are situated, said upstanding members comprising a pair of laterally spaced apart members having upwardly opening saddles, and wherein the windlass comprises an elongated bar having opposite end portions which set down into said saddles, with one of the end portions including a turning handle, and with the line means being wound onto said bar between said upstanding frame members.

9. A sawbuck according to claim 3, wherein said frame comprises a pair of spaced apart end portions defining upwardly opening spaces for receiving spaced apart portions of the bundle of limbs, and an avenue extending across the frame below the bundle of limbs in which a saw can be inserted, so that the bundle of limbs can be cut from the bottom upwardly, in a region between the ends of the sawbuck.

* * * * *